United States Patent [19]

Petrus

[11] 4,013,403

[45] Mar. 22, 1977

[54] SUPPORT MEANS FOR A ROLLER HEARTH IN A KILN

[75] Inventor: Francis X. Petrus, Glenshaw, Pa.

[73] Assignee: Pullman Incorporated, Pittsburgh, Pa.

[22] Filed: Dec. 8, 1975

[21] Appl. No.: 638,461

[52] U.S. Cl. ..... 432/239; 432/122; 432/246

[51] Int. Cl.[2] ..... F27D 3/00; F27B 9/14

[58] Field of Search ..... 432/239, 246, 121, 122, 432/124

[56] References Cited

UNITED STATES PATENTS

| | | | |
|---|---|---|---|
| 3,089,687 | 5/1963 | Peck | 432/124 X |
| 3,489,397 | 1/1970 | Alexander | 432/246 |
| 3,806,312 | 4/1974 | McMaster | 432/121 |

*Primary Examiner*—John J. Camby

*Attorney, Agent, or Firm*—Buell, Blenko & Ziesenheim

[57] ABSTRACT

A support means for the ceramic rolls of the roller hearth in a kiln. A means of support is provided for the roller hearth which can withstand the high temperatures and loadings of the kiln.

26 Claims, 12 Drawing Figures

SUPPORT MEANS FOR A ROLLER HEARTH IN A KILN

This invention relates to a support for the ceramic rolls of the roller hearth of a kiln and in particular to a support for the rolls which will withstand the high temperatures, friction and loads present in such kilns. Kilns are old and well known in the art, and ceramic roller hearths have been used in these kilns to facilitate the passage of work through them. At present, however, the ceramic rollers of the hearth are limited in length by limitations in tube technology. Since the length of the ceramic rollers is limited, a corresponding limitation is imposed on the width of the hearth. The limitation of width necessarily limits the width of the work pieces or the number of work pieces which can be conveyed by the roller hearth at any given time. Various attempts have been made to overcome the limitations of roller tube technology, but to date no feasible or economic way has been proposed which will overcome these limitations.

The present invention provides a significant improvement in present kiln roller hearth design and construction. The invention provides a support for the ceramic rolls of the roller hearth which is economically and easily constructed and is able to withstand the temperatures, friction and loads encountered in a kiln. The invention permits ceramic rolls of greater length to be used in the roller hearths of kilns thereby permitting an increase in the size and capacity of a kiln while using existing ceramic roll technology. In a preferred form of my invention, I provide a support beam for the ceramic rolls of the roller bed of the kiln. The support beam is adapted to engage the rolls thereby supporting the rolls and providing the drive force for them. The support beam is moveable transversely of the ceramic rolls by means of a hydraulic ram. Piston means move the support means upward to engage the ceramic rolls and downward out of engagement when the drive stroke is completed.

When the hydraulic ram draws the support beam forward, the piston means and the support beam elevate it to contact the bottom surface of the individual ceramic rolls. This is the drive stroke wherein the support beams frictionally engages the ceramic rolls causing them to rotate thereby moving the pieces through the kiln. At the completion of the drive stroke the ram returns the support beam to its original position and the piston means cause the support beam to lower out of engagement with the ceramic rolls. The cycle is repeated until all the work pieces are moved through the tunnel kiln. In the foregoing general description, I have set certain purposes, objects and advantages of my invention.

It will be described hereafter and will become apparent for those skilled in the art of the construction and operation of roller hearth tunnel kilns when considering the following description and the drawings in which.

Figure 1:
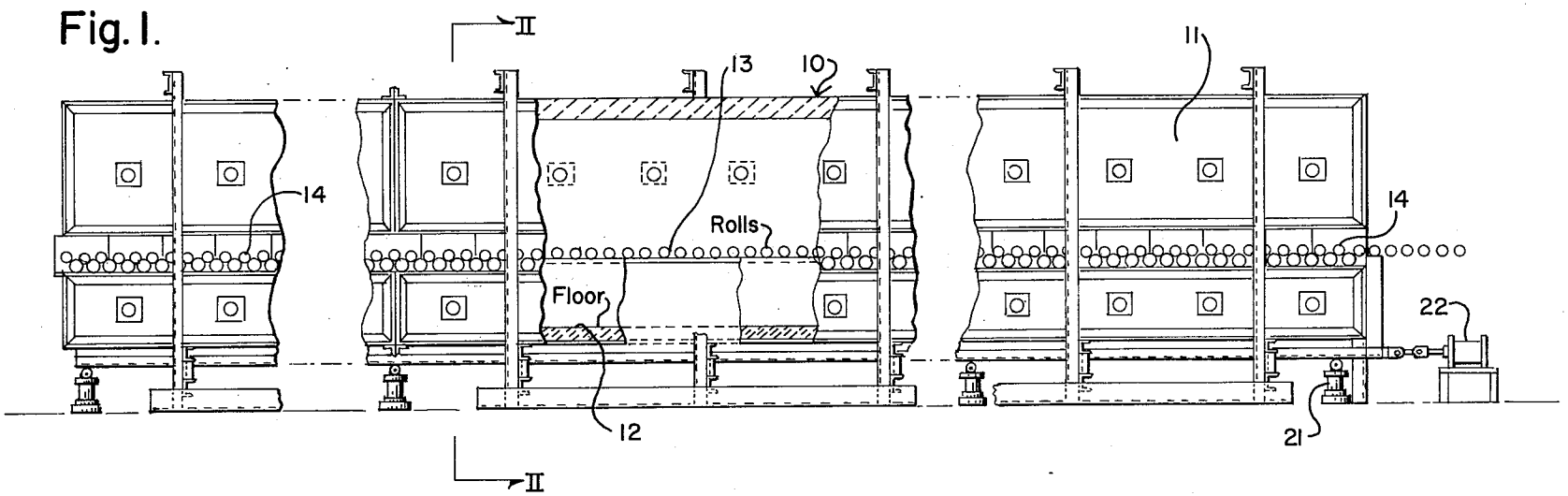
FIG. 1 is a fragmentary longitudinal view of a tunnel kiln partly in section.
Figure 3:
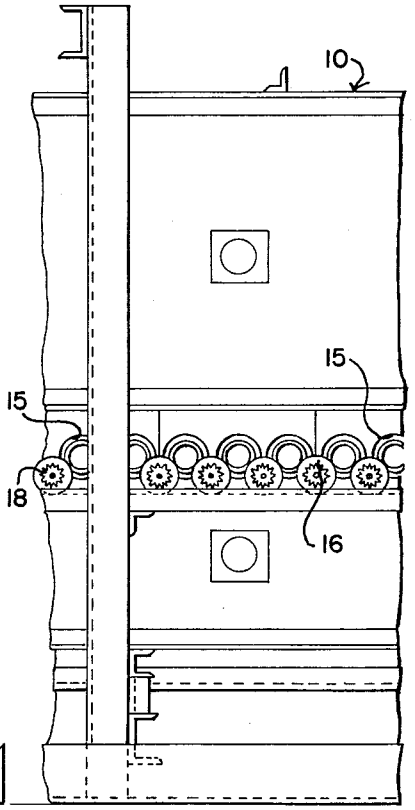
FIG. 3 is a partial side elevational view of FIG. 2 as seen from the right thereof.

Referring to the drawings, I have illustrated in FIG. 1 a roller hearth tunnel kiln 10 having sidewalls 11 and floor 12. The roller hearth 13 of kiln 10 is comprised of individual ceramic rolls 14. The individual rolls 14 span the width of the kiln and extend outwardly of the sidewalls 11 through apertures 15. Rolls 14 are supported by means of wheel supports 16 are fixed on shafts 17 which are rotatably mounted to the frame of kiln 10 by means well known in the art. Sprockets 18 are mounted on the fore end of shafts 17.

Figure 2:
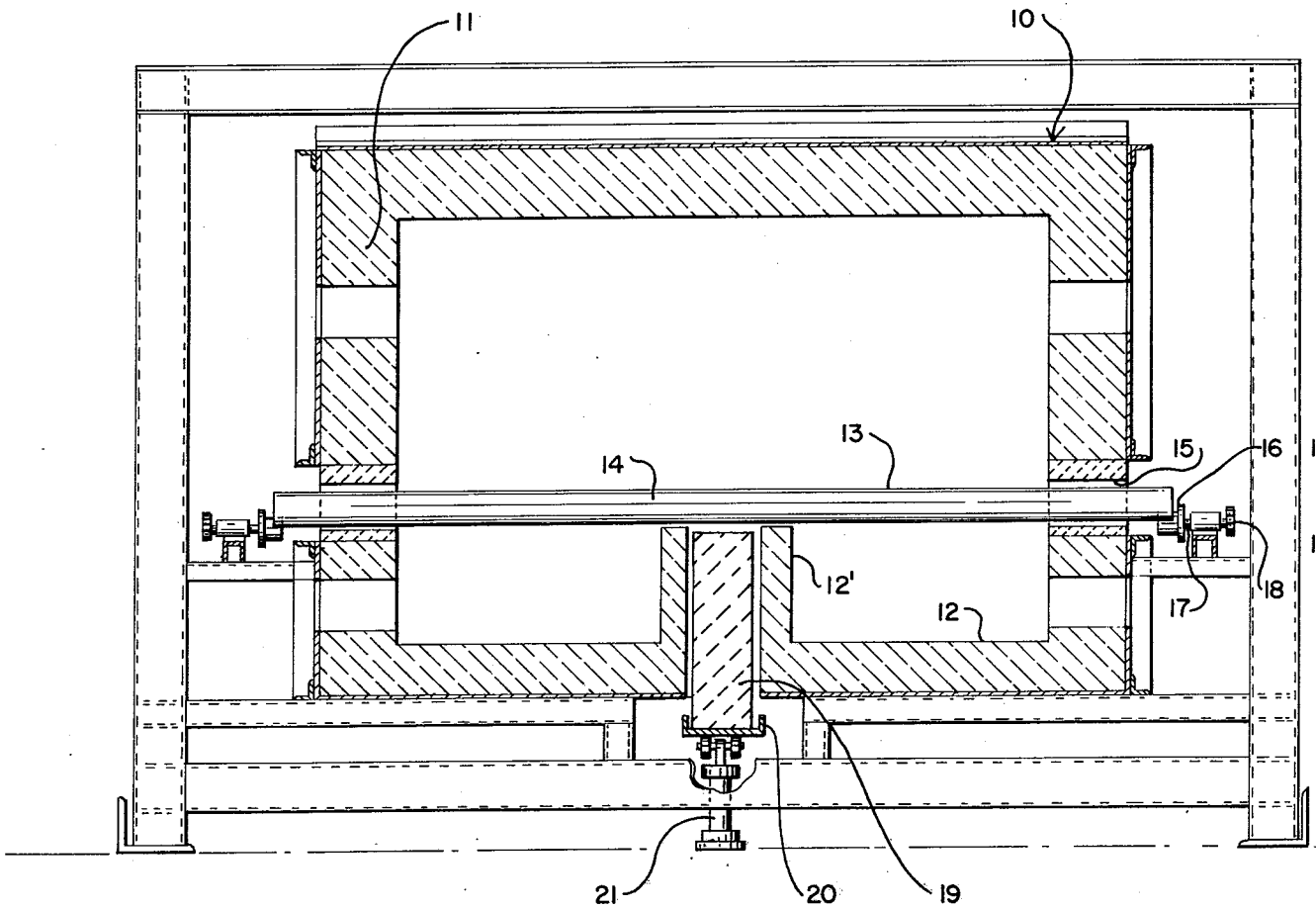
FIG. 2 is a transverse sectional view through the kiln of FIG. 1 taken on line 2—2.

Referring to FIG. 2, support beam 19 which can be made of ceramic or other material of suitable strength and heat resistance is mounted in channel 20. Hydraulic piston means 21 are operably connected to support beam 19 to raise the beam to engage rolls 14 and lower the beam from engagement with said rolls. Hydraulic ram means 22 is operably connected to one end of beam 19 and moves beam 19 transversely of the individual rolls 14.

In operation, work pieces, not shown, would be placed on rolls 14 for firing while moving through kiln 10. Beam 19 would be simultaneously raised by cylinders 21 and drawn forward by ram 22. When beam 19 is raised, it would engage rolls 14 causing them to rise off the elevated section 12' of floor 12. The forward movement of beam 19 by means of ram 22 which frictionally engaging rolls 14 will cause rotation of rolls 14 thereby causing the work pieces to travel over the rolls and through the kiln. When ram 22 has reached the end of its forward stroke, the beam is lowered by cylinders 21 and returned to its original position by the return stroke of ram 22. The rolls now rest on the elevated section 12' of floor 12. The cycle is then repeated as often as necessary to move all of the work pieces through the kiln.

Figure 4:
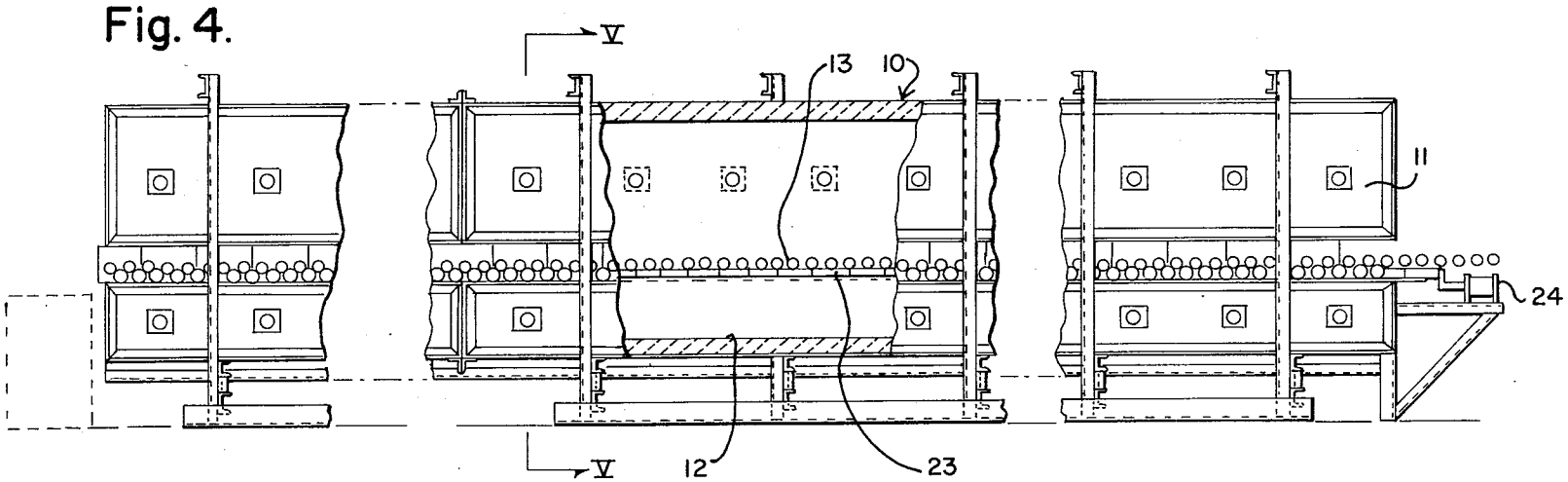
FIG. 4 is a fragmental longitudinal view of a tunnel kiln partly in section showing an alternative embodiment of the present invention.
Figure 5:
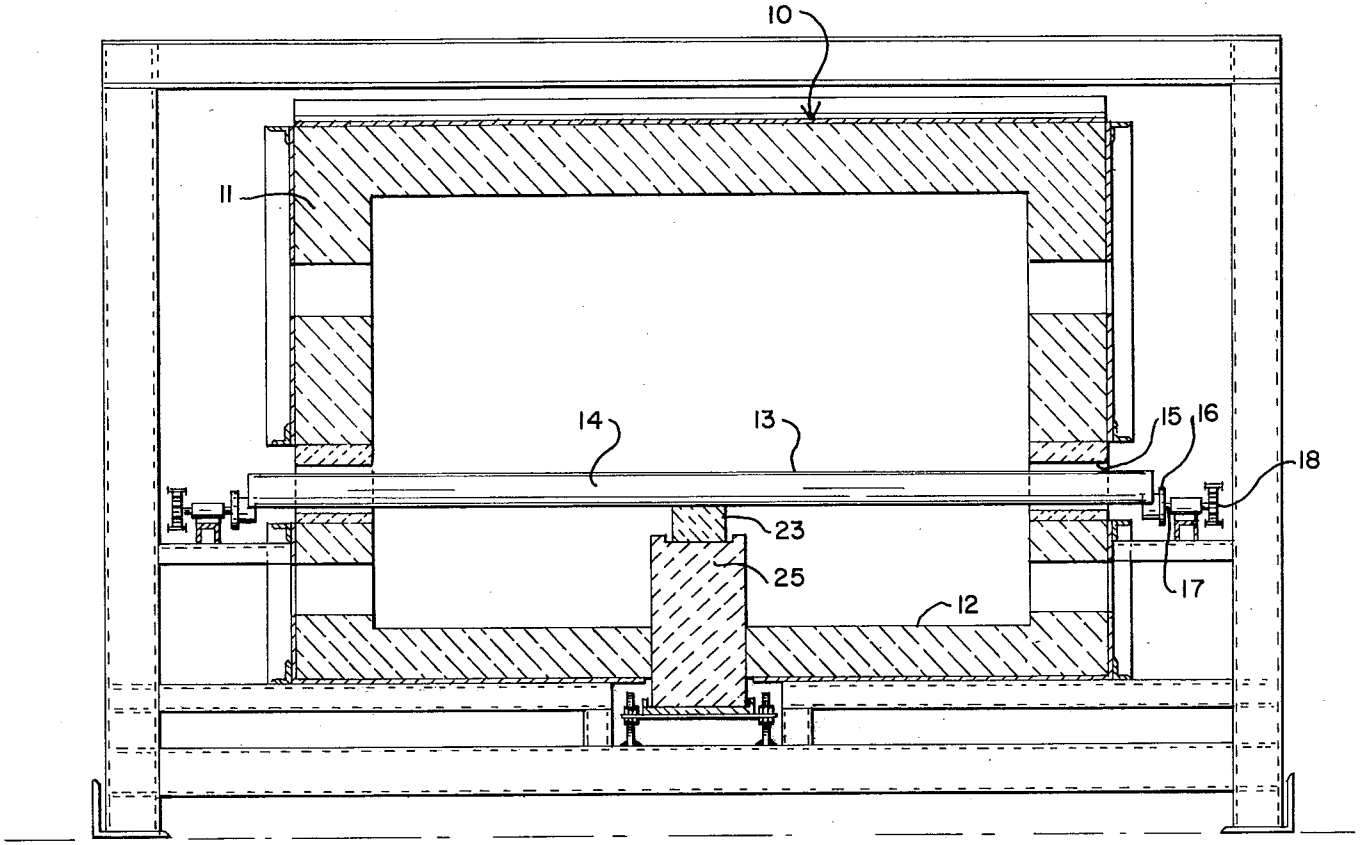
FIG. 5 is a transverse sectional view through the kiln of FIG. 4 taken on line 4—4.
Figure 6:
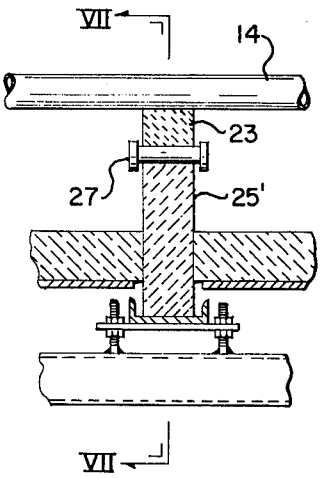
FIG. 6 is a fragmentary section of an alternate center line support means of the present invention.
Figure 7:
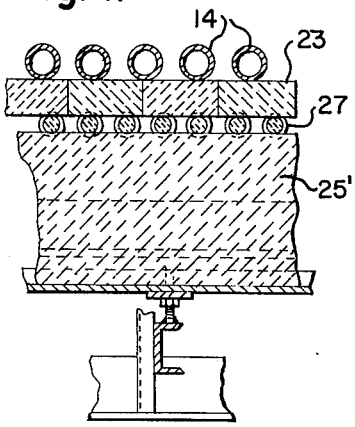
FIG. 7 is a sectional view taken on line 6—6 of FIG. 6.

FIGS. 4 and 5 show one alternate form of my invention. Support blocks 23 are pushed through the kiln under rolls 14 by means of ram 24. The operation of ram 24 and the recirculation of blocks 23 are not shown but are well known and understood in the art. Support blocks 23 are made of ceramic or the like and are guided through kiln 10 by within guide channel 25. The movement of blocks 23 which frictionally engage rolls 14 would cause rotation of the rolls and movement of any work pieces through the kiln. The guide channel may have the configuration 25' as shown in FIG. 6. In this embodiment, flanged ceramic rollers 27 are interposed between support blocks 23 and channel 25'.

Figure 8:
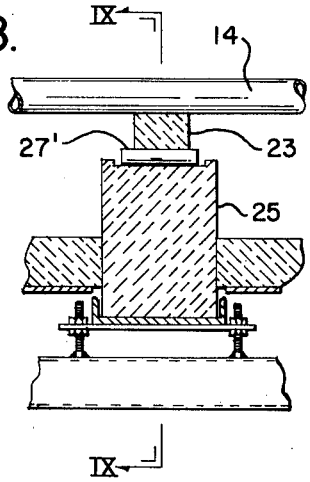
FIG. 8 is a fragmentary sectional view of another alternative center line support means of the present invention.
Figure 9:
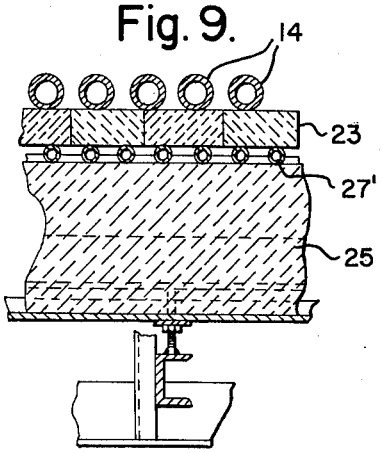
FIG. 9 is a sectional view taken on line 8—8 of FIG. 8.
Figure 10:
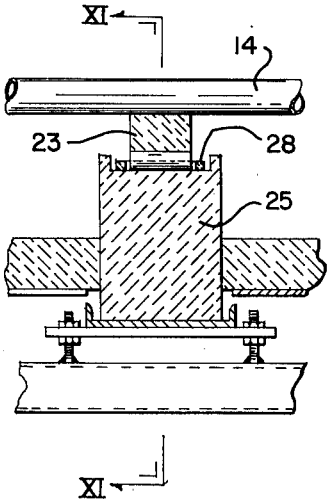
FIG. 10 is another alternative center line support means of the present invention.
Figure 11:
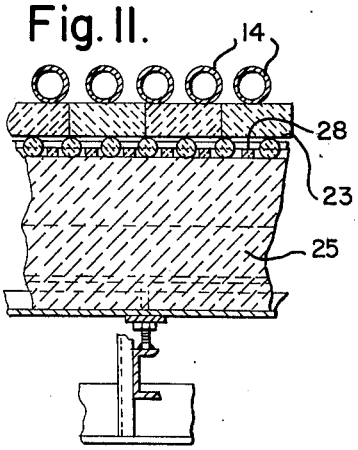
FIG. 11 is a sectional view taken along line 10—10 of FIG. 10.

Ceramic rollers 27′ can also be placed within support channel 25 as shown in FIGS. 8 and 9. In FIGS. 10 and 11, guide channel 25 includes ceramic spacer means 28 which would retain ceramic rollers 27′ in place within guide channel 25.

Figure 12:
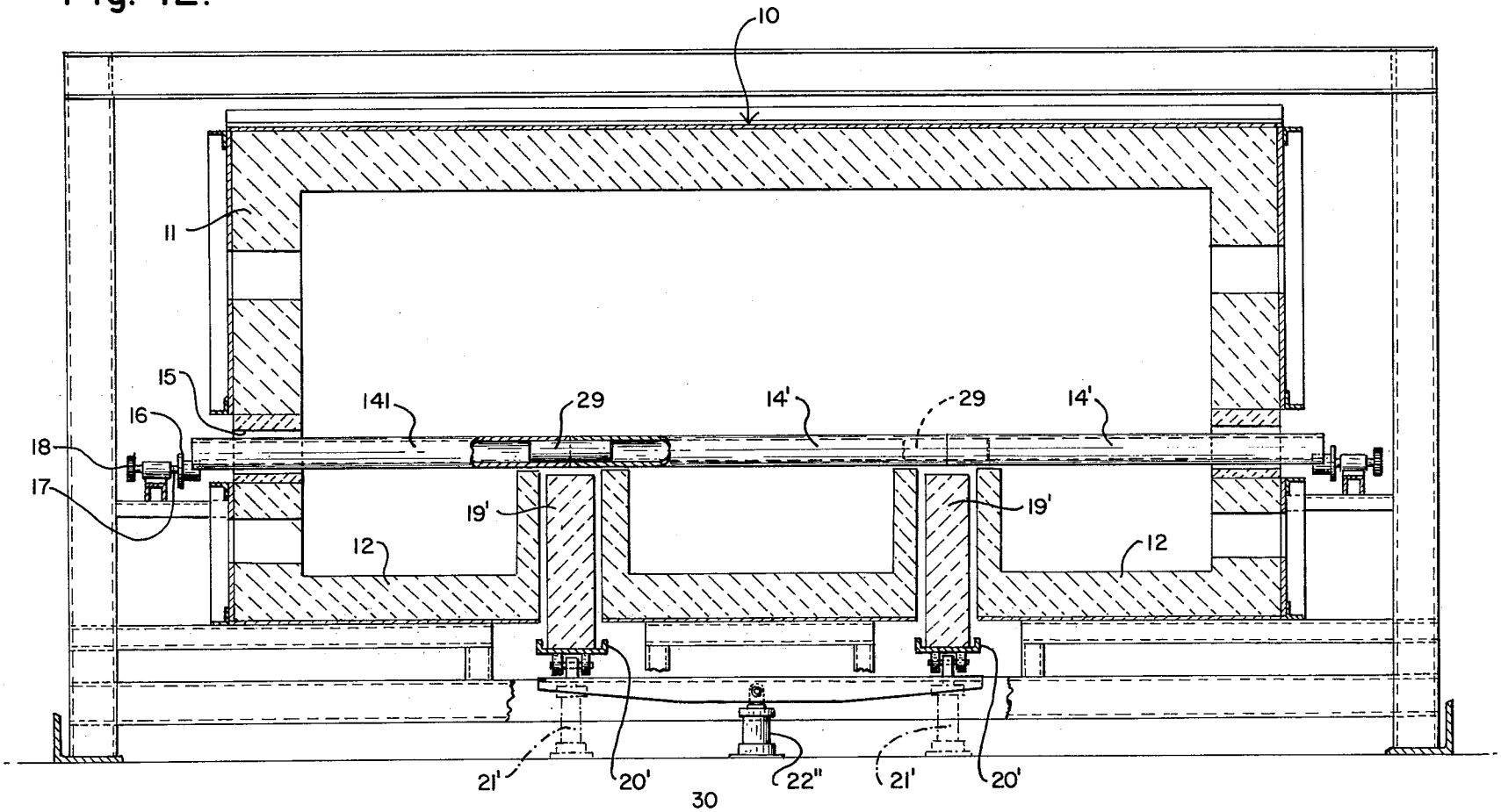
FIG. 12 is a sectional view of an alternate embodiment of the invention.

FIG. 12 shows another embodiment of the invention. The support system may include a plurality of support beams or guide channels. In the embodiment shown, there are two support beams 19′. Rolls 14′ can be joined by members 29 to further increase the width of the hearth. Beams 19′ are mounted in channels 20′. Hydraulic piston means 21′ are operably connected to beams 19′ to raise the beams to engage rolls 14′ and lower the beams from engagement with said rolls. Hydraulic ram means 22′ (not shown) are operably connected to one end of the beams 19′ and move beams 19′ transversely of the individual rolls 14′. The operation of each piston 21′ and ram 22′ is synchronized by means known and understood in the art to permit coordinated movement of beams 19′. Alternately a single piston 21″ could be used with balance beam 30 to operate beams 19′.

In any of the embodiments of my invention, additional outside chain drive means for the rollers can be provided through sprockets 18 by means well known in the art.

Thus, the size and capacity of a roller hearth tunnel kiln are not limited by existing ceramic roll technology and larger and more efficient kilns can be built.

In the foregoing specification, I have set out certain preferred embodiments of my invention, however, if will be understood that this invention may be otherwise embodied within the scope of the following claims.

I claim:

1. A kiln roller hearth support comprising:
   a. an elevated ceramic base fixably attached to the floor of said kiln,
   b. a support beam aligned inwardly of the walls of said base,
   c. lifting means for raising and lowering said support beam inwardly of said base, said support beam having an upper surface which when raised is adapted to frictionally engage the rolls of the roller hearth so as to cause rotation of said rolls and from contact with the said rolls; and
   d. drive means for moving said support beam forward and rearward with said tunnel kiln.

2. The kiln roller hearth support of claim 1 wherein said support beam engages the rolls so as to provide support at the midpoint of said rolls.

3. A kiln roller hearth having the support means of claim 2 wherein said rolls of said roller hearth have drive means operably engaged to the sprockets thereof to cause rotation of said rolls.

4. A kiln roller hearth comprising:
   a. a plurality of elevated ceramic bases fixably attached to the floor of said kiln, said bases aligned in pairs having the inward walls of said pairs forming a channel longitudinally of said kiln,
   b. a support beam aligned in said channels formed by said walls of said bases,
   c. lifting means for raising and lowering said support means in said channels to and from contact with the rolls of the roller hearth; and
   d. drive means for moving said support beams forward and rearward within said channel.

5. The kiln roller hearth support of claim 4 wherein said support beam frictionally engages the rolls of said roller hearth so as to cause rotation of the rolls during forward movement of said support beams.

6. The kiln roller hearth support of claim 5 wherein the rolls of said roller hearth are rotated by drive means operably engaged to the sprockets thereof.

7. A kiln roller hearth support comprising:
   a. an elevated ceramic guide channel fixably attached to the floor of said kiln, said guide channel being adapted to receive ceramic support bodies,
   b. ceramic support bodies adapted to be received by said guide channel and said support bodies operably engaging the underside of the rolls of said roller hearth; and
   c. drive means for moving said support bodies over said guide channel through said kiln.

8. The kiln roller hearth support of claim 7 wherein said support bodies frictionally engage the rolls of said roller hearth so as to cause rotation thereof by means of the movement of said bodies through said kiln.

9. The kiln roller hearth support of claim 8 wherein the rolls of said roller hearth are rotated by drive means operably engaged to the sprockets thereof.

10. The kiln roller hearth support of claim 9 wherein flanged ceramic roller bodies engage said guide channel and said roller bodies are in operable contact with said support bodies.

11. The kiln roller hearth support of claim 12 wherein spacer means are inserted between said roller bodies.

12. The kiln roller hearth support of claim 11 wherein the rolls of said roller hearth are rotated by drive means operably engaged to the sprockets thereof.

13. A kiln roller hearth support comprising:
   a. an elevated ceramic guide channel fixably attached to the floor of said kiln, said guide channel having a recessed upper surface adapted to receive ceramic support bodies and ceramic roller bodies,
   b. ceramic roller bodies operably engaging said recessed surface of said guide channel,
   c. ceramic support bodies operably engaging the said ceramic roller bodies, said ceramic support bodies adapted to engage the underside of said roller hearth; and
   d. drive means for moving said support bodies over said roller bodies in said guide channel through said kiln.

14. A kiln roller hearth support comprising:
   a. an elevated ceramic guide channel fixably attached to the floor of said kiln, said guide channel having a recessed upper surface adapted to receive ceramic support bodies and ceramic roller bodies,
   b. ceramic roller bodies operably engaging said recessed surface of said guide channel,
   c. spacer means between each of said ceramic roller bodies,
   d. ceramic support bodies operably engaging the said ceramic roller bodies, said ceramic support bodies adapted to engage the underside of the rolls of said roller hearth; and
   e. drive means for moving said support bodies over said roller bodies in said guide channel through said kiln.

15. The kiln roller hearth support of claim 14 wherein said ceramic support bodies operably engage the underside of the rolls of said roller hearth so as to cause rotation thereof by means of said support bodies movement through said kiln.

16. A kiln roller hearth having the support means of claim 15 wherein said rolls of said roller hearth have drive means operably engaged to the sprockets thereof to cause rotation of said rolls.

17. A kiln roller hearth support comprising:

a. elevated ceramic guide channels fixably attached to the floor of said kiln, said guide channels being adapted to receive ceramic support bodies, b. ceramic support bodies adapted to be received by said guide channels and said support bodies operably engaging the underside of the rolls of said roller hearth; and c. drive means for moving said support bodies over said guide channels through said kiln.

18. The kiln roller hearth support of claim 17 wherein said support bodies frictionally engage the rolls of said roller hearth so as to cause rotation thereof by means of the movement of said bodies through said kiln.

19. The kiln roller hearth support of claim 18 wherein the rolls of said roller hearth are rotated by drive means operably engaged to the sprockets thereof.

20. The kiln roller hearth support of claim 19 wherein flanged ceramic roller bodies engage said guide channels and said roller bodies are in operable contact with said support bodies.

21. The kiln roller hearth support of claim 20 wherein spacer means are inserted between said roller bodies.

22. The kiln roller hearth support of claim 21 wherein the rolls of said roller hearth are rotated by drive means operably engaged to the sprockets thereof.

23. A kiln roller hearth support comprising:

a. elevated ceramic guide channels fixably attached to the floor of said kiln, said guide channels having a recessed upper surface adapted to receive ceramic support bodies and ceramic roller bodies, b. ceramic roller bodies operably engaging said recessed surface of said guide channels, c. ceramic support bodies operably engaging the said ceramic roller bodies, said ceramic support bodies adapted to engage the underside of said roller hearth; and d. drive means for moving said support bodies over said roller bodies in said guide channels through said kiln.

24. A kiln roller hearth support comprising:

a. elevated ceramic guide channels fixably attached to the floor of said kiln, said guide channels having a recessed upper surface adapted to receive ceramic support bodies and ceramic roller bodies, b. ceramic roller bodies operably engaging said recessed surface of said guide channels, c. spacer means between each of said ceramic roller bodies, d. ceramic support bodies operably engaging the said ceramic roller bodies, said ceramic support bodies adapted to engage the underside of the rolls of said roller hearth; and e. drive means for moving said support bodies over said roller bodies in said guide channels through said kiln.

25. The kiln roller hearth support of claim 24 wherein said ceramic support bodies operably engage the underside of the rolls of said roller hearth so as to cause rotation thereof by means of the movement of said bodies through said kiln.

26. The kiln roller hearth support of claim 25 wherein the rolls of said roller hearth are rotated by drive means operably engaged to the sprockets thereof.

* * * * *

UNITED STATES PATENT AND TRADEMARK OFFICE

CERTIFICATE OF CORRECTION

PATENT NO. : 4,013,403

DATED : March 22, 1977

INVENTOR(S) : FRANCIS X. PETRUS

It is certified that error appears in the above-identified patent and that said Letters Patent are hereby corrected as shown below:

Column 1, line 48, after "the" should read --work--.

Column 2, line 6, after "section" should read --view--.

Column 3, Claim 4, line 63, "means" should read --beams--.

Column 4, Claim 11, line 27, "12" should read --10--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*